US011986720B2

(12) United States Patent
Williamson, Jr.

(10) Patent No.: US 11,986,720 B2
(45) Date of Patent: May 21, 2024

(54) EXERCISE PATH APPROACHING PERSON SIGNALING DEVICE AND METHOD

(71) Applicant: Tony Maurice Williamson, Jr., Beaverton, OR (US)

(72) Inventor: Tony Maurice Williamson, Jr., Beaverton, OR (US)

( * ) Notice: Subject to any disclaimer, the term of this patent is extended or adjusted under 35 U.S.C. 154(b) by 151 days.

(21) Appl. No.: 17/694,149

(22) Filed: Mar. 14, 2022

(65) Prior Publication Data

US 2023/0285835 A1 Sep. 14, 2023

(51) Int. Cl.
*A63B 71/06* (2006.01)

(52) U.S. Cl.
CPC .. *A63B 71/0622* (2013.01); *A63B 2071/0627* (2013.01)

(58) Field of Classification Search
CPC ..... A63B 71/0622; A63B 2071/0627
See application file for complete search history.

(56) References Cited

U.S. PATENT DOCUMENTS 4,245,218 A 1/1981 Berkebile
5,365,213 A 11/1994 Paull
5,420,570 A 5/1995 Leitten
5,638,767 A 6/1997 Bush
6,529,121 B2 3/2003 Bush
D784,327 S 4/2017 Akana
2006/0187066 A1 8/2006 Chen
2014/0221797 A1* 8/2014 Bailey ..... A61B 5/0205 600/595
2016/0066636 A1* 3/2016 West ..... A45F 5/021 150/154
2021/0052221 A1* 2/2021 Panneer Selvam ... A61B 5/1117
2021/0405142 A1* 12/2021 Pipher ..... G01C 21/3697

FOREIGN PATENT DOCUMENTS

WO WO8705137 8/1987
WO WO 2005084388 * 3/2005 ..... G08B 25/016

* cited by examiner

*Primary Examiner* — Hongmin Fan

(57) ABSTRACT

An exercise path approaching person signaling device includes a housing that has a top wall, a bottom wall, and a perimeter wall attached to extending between the top and bottom walls. A wristband is attached to the housing and is releasably mounts the housing on a person's wrist. A sound emitter is mounted in the housing and emits a warning sound having a volume of at least 70 decibels when turned on. The sound emitter includes a switch mounted on the housing. The sound emitter is turned on to emit an alert sound when the switch is actuated.

11 Claims, 5 Drawing Sheets

EXERCISE PATH APPROACHING PERSON SIGNALING DEVICE AND METHOD

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to passing runner alerting device and more particularly pertains to a new passing runner alerting device for allowing a person to alert others they are about to pass without using their voice. This is particularly helpful when the person is physically stressed from exercising and cannot easily vocalize a warning that they are overtaking another person.

(2) Description of Related Art Including Information Disclosed Under 37 CFR 1.97 and 1.98

The prior art relates generally to sound makers such as bells that are positioned on a bicycle but which are not conducive for wearing or using while running.

BRIEF SUMMARY OF THE INVENTION

An embodiment of the disclosure meets the needs presented above by generally comprising a housing that has a top wall, a bottom wall, and a perimeter wall attached to extending between the top and bottom walls. A wristband is attached to the housing and is releasably mounts the housing on a person's wrist. A sound emitter is mounted in the housing and emits a warning sound having a volume of at least 70 decibels when turned on. The sound emitter includes a switch mounted on the housing. The sound emitter is turned on to emit an alert sound when the switch is actuated.

In another embodiment, a method of warning a forward person on a path that a rearward person on the path is imminently about to pass the forward person includes placing on the wrist of the rearward person a housing having a top wall, a bottom wall, and a perimeter wall attached to extending between the top and bottom walls. A wristband is attached to the housing and releasably mounts the housing on the rearward person's wrist. A sound emitter, in the housing, is actuated by the rearward person as the rearward person approaches the forward person to alert the forward person of a position of the rearward person and that the rearward person is about to pass the forward person. An alert sound is emitted by the sound emitter when the sound emitter is actuated.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
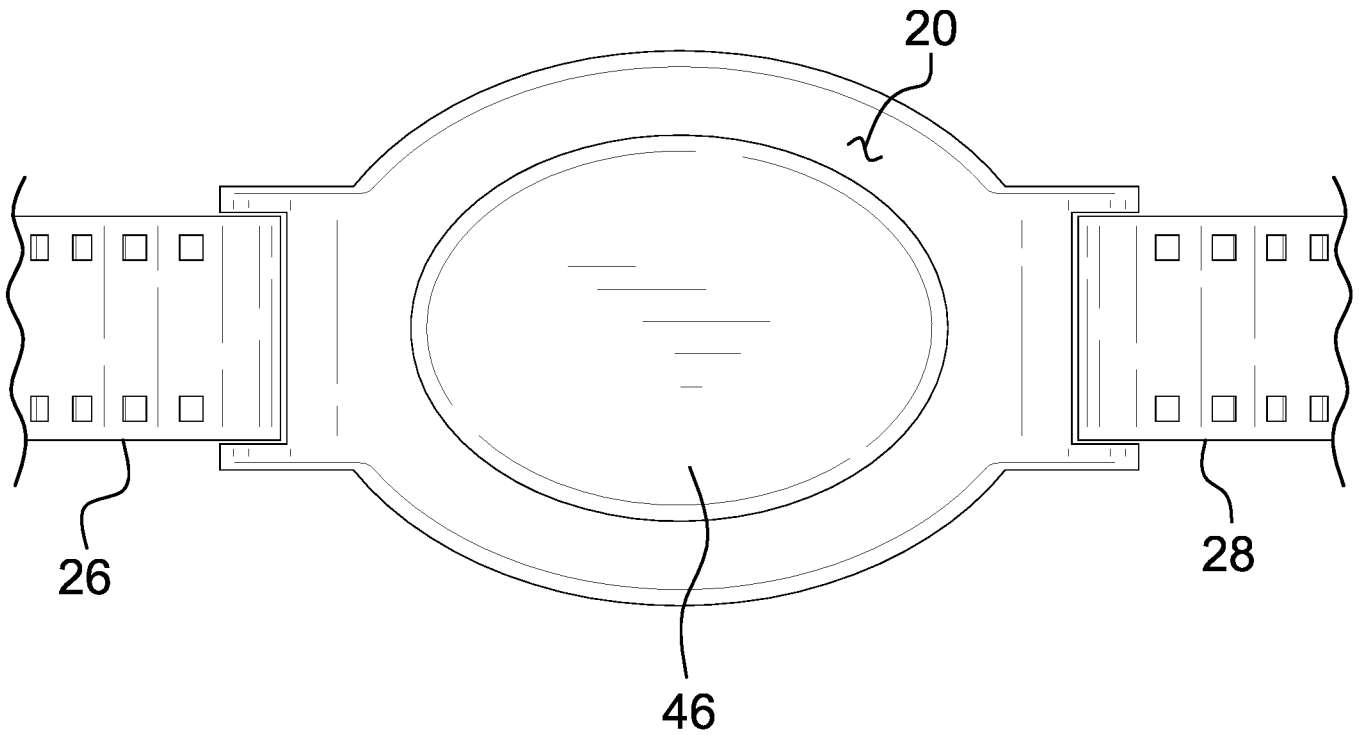
FIG. 1 is a top view of a exercise path approaching person signaling device and method according to an embodiment of the disclosure.
Figure 2:
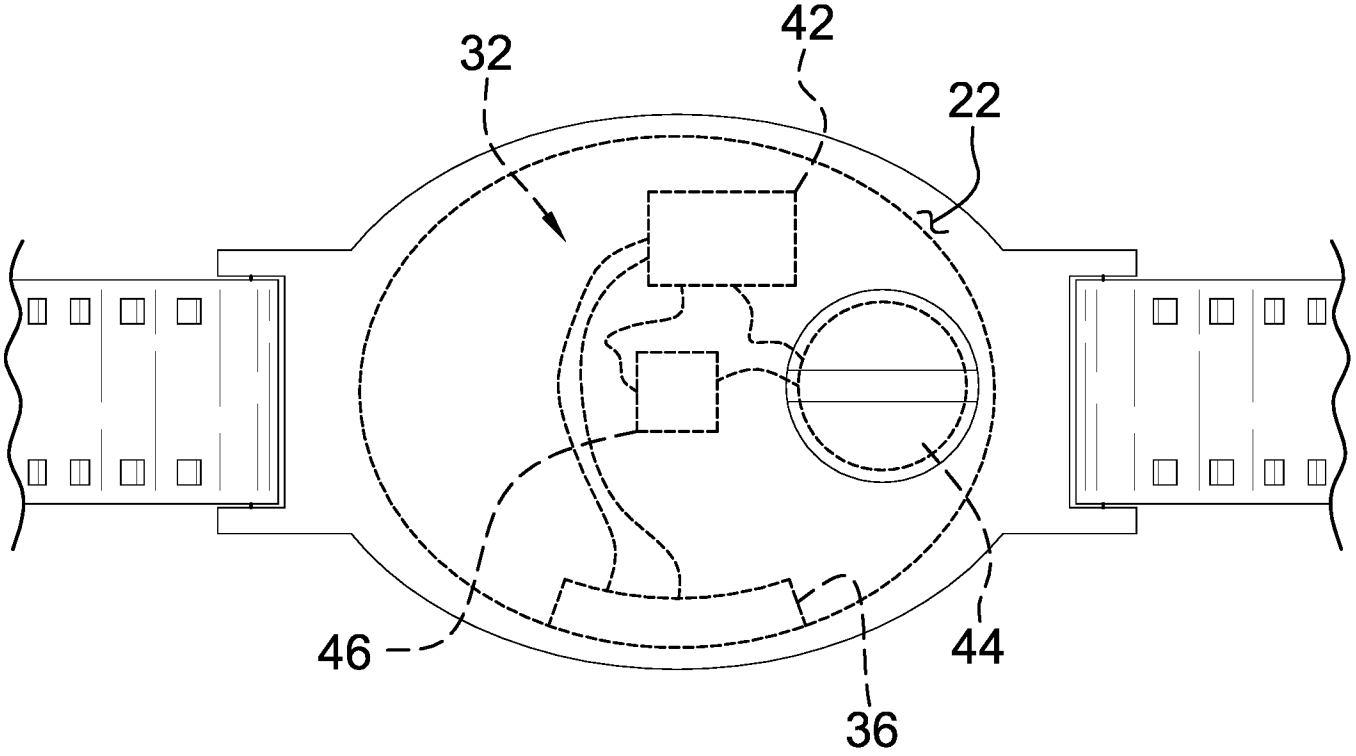
FIG. 2 is a bottom view of an embodiment of the disclosure.
Figure 3:
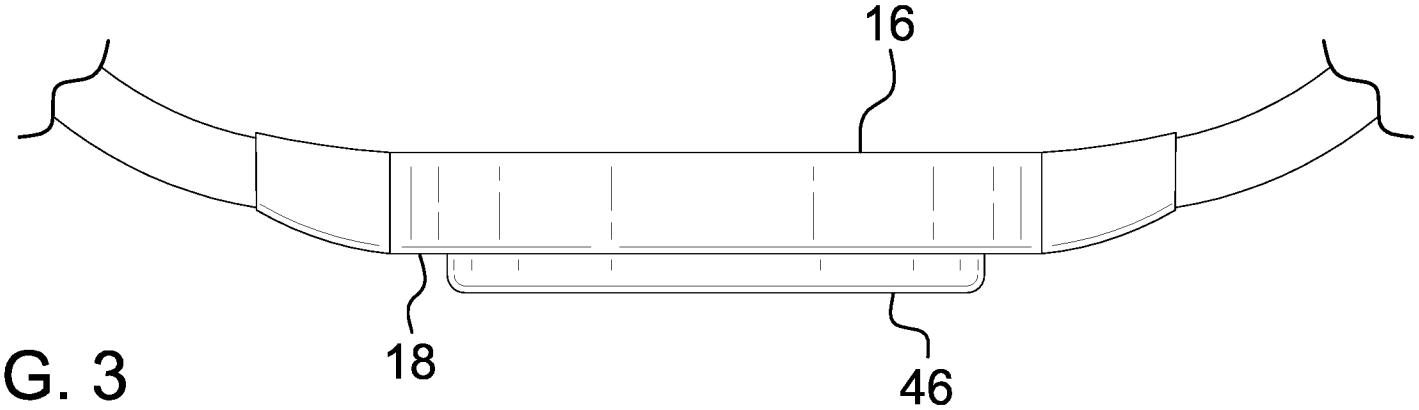
FIG. 3 is a rear view of an embodiment of the disclosure.
Figure 4:
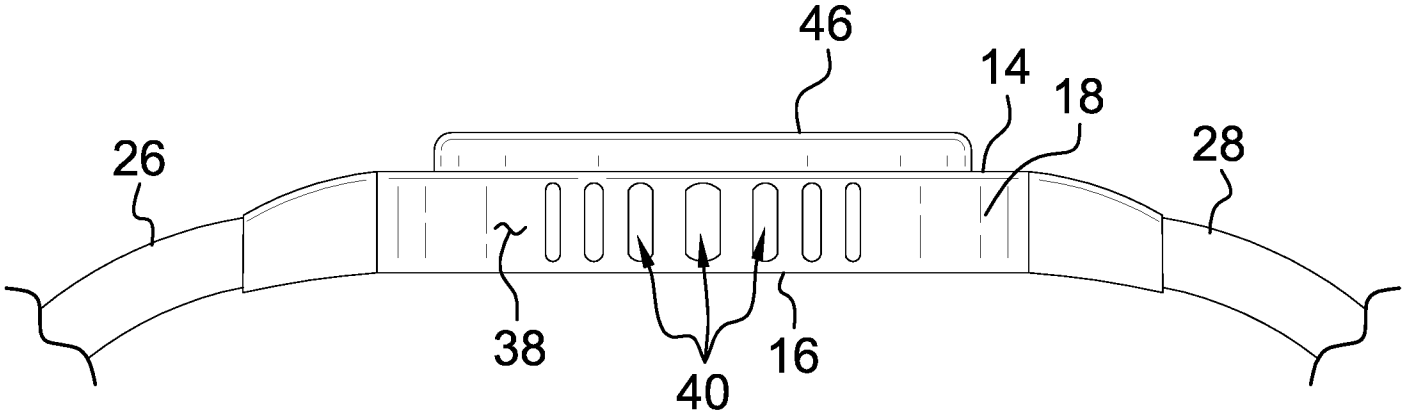
FIG. 4 is a front view of an embodiment of the disclosure.
Figure 5:
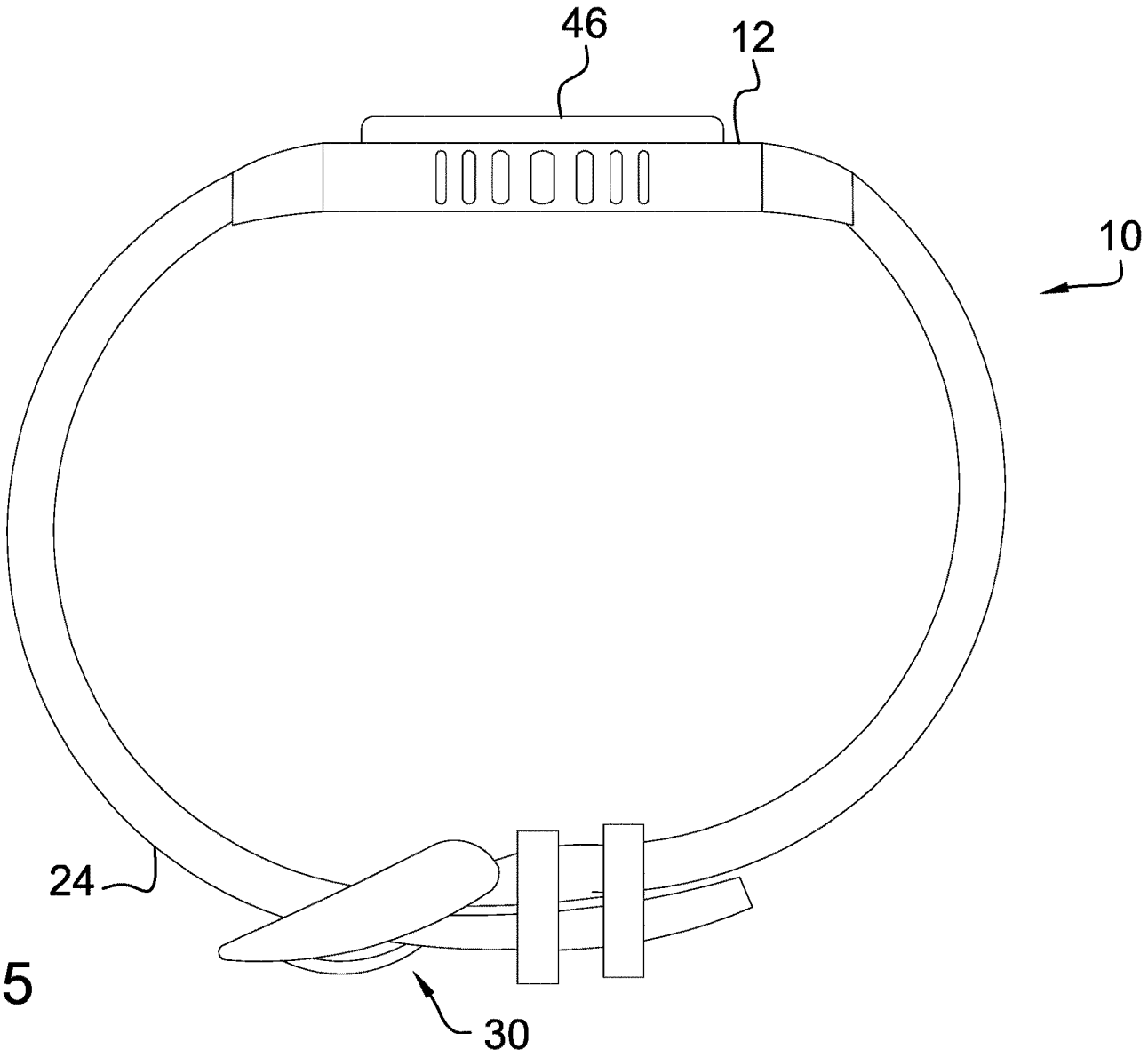
FIG. 5 is a front view of an embodiment of the disclosure.
Figure 6:
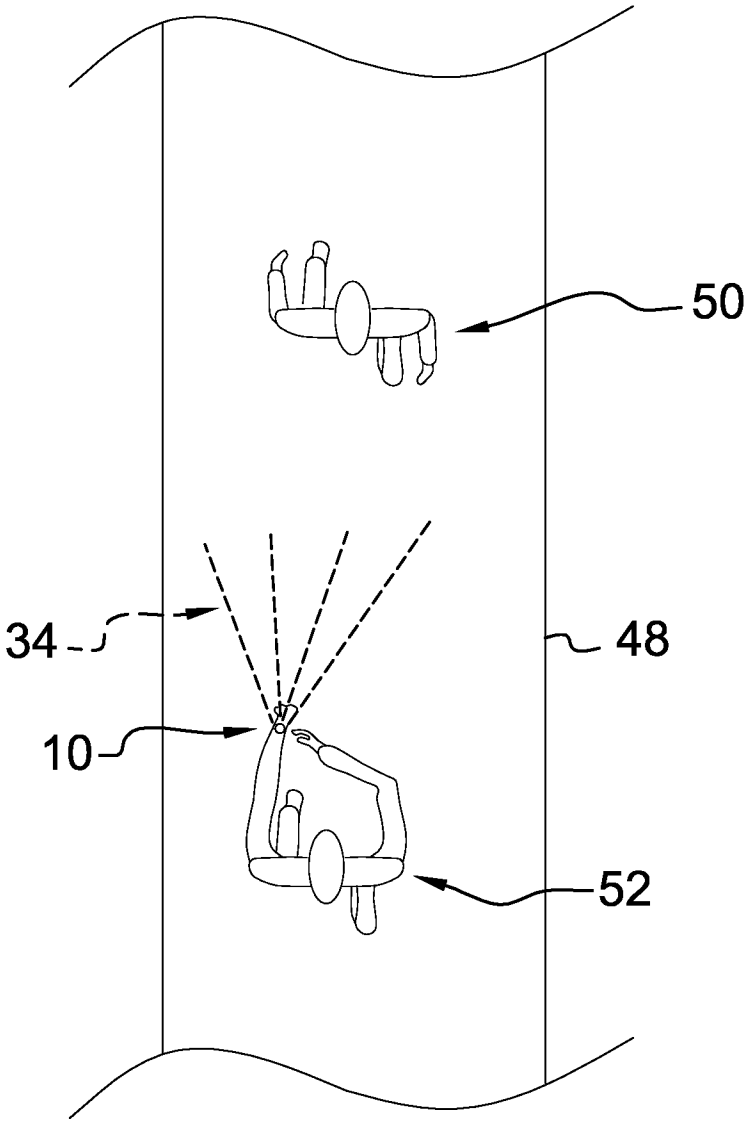
FIG. 6 is a top in-use view of an embodiment of the disclosure.

With reference now to the drawings, and in particular to FIGS. 1 through 6 thereof, a new passing runner alerting device embodying the principles and concepts of an embodiment of the disclosure and generally designated by the reference numeral 10 will be described.

As best illustrated in FIGS. 1 through 6, the exercise path approaching person signaling device 10 and method generally comprises a housing 12 that has a top wall 14, a bottom wall 16, and a perimeter wall 18 that is attached to extends between the top 14 and bottom 16 walls. An upper surface 20 of the top wall 14 and a lower surface 22 of the bottom wall 16 each will typically have an area that is less than 2.0 $in^2$, while the housing 12 overall will generally encompass a total volume of less than 4.0 $in^2$. More particularly, the housing 12 will most often have a size corresponding to a typical wrist watch to ensure that it is comfortable to wear.

A wristband 24 is attached to the housing 12 and is configured to releasably mount the housing 12 on a person's wrist. The wristband 24 may include a first section 26 attached to the housing 12 and a second section 28 attached to the housing 12 opposite of the first section 26. A coupler 30 releasably secures the first 26 and second 28 sections together. The coupler 30 may include conventional wristband closures such as clasps and buckles, though snaps, hooks and loop couplers, and magnets may also be employed. Alternatively, the wristband 24 may be a resiliently stretchable material which does not include a coupler such as a buckle or clasp.

A sound emitter 32 is mounted in the housing 12. The sound emitter 32 is typically capable of emitting an alert sound 34 having a volume of at least 70 decibels when turned on. Generally, the sound will be between 70 decibels and 90 decibels. The sound emitter 32 may be programmable or include a volume control should the user determine that particular circumstances warrant louder or quieter alert sounds 34. The sound emitter 32 includes at least one speaker 36. The perimeter wall 18 includes a front edge 38 which will typically be directed toward the user's hand, wherein the front edge 38 has a plurality of openings 40 extending therethrough. The speaker 36 is directed toward the openings 40 to facilitate the directing of the sound by the person using the device 10. In some embodiments, the openings 40 are positioned between the first 26 and second 28 wrist sections.

The sound emitter 32 includes a control chip 42 that is programmed with an alert sound 34 and the device 10 may include the ability to re-program or pre-program the control chip 42 to produce selectable alternate alert sounds 34. The alert sound 34 may comprise any sound emitted that will effectively warn a person that another person is about to pass on a path. Thus, the alert sound 34 may be a programmed voice stating that a person is about to pass or may include a conventional beeping or chirping sound. For chirping or beeping sounds, the alert sound will typically have a frequency of between 1000 Hz and 5000 Hz. A power supply 44, such as a battery, is mounted in the housing 12 and electrically coupled to the control chip 42.

The sound emitter 32 includes a switch 46 mounted on the housing 12. The sound emitter 32 is turned on to emit the alert sound 34 when the switch 46 is actuated. The switch 46 may comprise a push button positioned on the top wall 14 wherein the alert sound 34 is emitted only when the push button is forcibly depressed. However, the control chip 42 may be programmed so that the alert sound 34 plays for a pre-determined amount of time each time the switch 46 is actuated.

In use, the device 10 is used for alerting walkers, bike riders, and the like that a person is passing them on a trail 48, such as trails, paths, or walkways used for running, biking, and walking. As an example provided for in FIG. 6, a pair of people positioned on a trail 48 and spaced from each other define a forward person 50 and a rearward person 52 relative to each other when traveling in a same direction with respect to each other on the trail 48. When the rearward person 52 is traveling faster and will intercept and pass the forward person 50, it is important that the forward person 50 is warned to ensure that the forward person 50 does not move in such a manner that the rearward person 52 strikes the forward person 50 or otherwise is forced to deviate quickly due to unexpected lateral movement on the part of the forward person 50. Additionally, it considered common courtesy to warn the forward person 50 to avoid startling them when being approached from the rear. Before passing the forward person 50, the rearward person 52 actuates the sound emitter 32 to audibly signal and alert the forward person 50 that the rearward person 52 is near and is about to pass the forward person 50. This is particularly useful when the rearward person 52 is running and may be out of breath to the point that alerting the forward person 50 is physically demanding.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An audible runner traffic warning assembly to alert forwardly positioned persons on a path that another person is approaching from behind, the assembly comprising:

a housing having a top wall, a bottom wall, and a perimeter wall being attached to extending between the top and bottom walls, the perimeter wall including a front edge, the front edge having a plurality of openings extending therethrough, the front edge being convex, the plurality of openings including a centrally positioned opening and a plurality of outer pairs being equally spaced from the central opening, each of the plurality of openings being elongated, a width of the openings of the outer pairs of openings decreasing extending away from the central opening relative to a width of the central opening, the width of each opening of each of the outer pairs of openings being equal wherein the plurality of openings are symmetrical about a central longitudinal axis of the central opening;

a wristband being attached to the housing and being configured to releasably mount the housing on a person's wrist such that the front edge of the perimeter wall is configured to face the person's hand;

a sound emitter being mounted in the housing, the sound emitter emitting a warning sound having a volume of at least 70 decibels when turned on; and the sound emitter including a switch, the switch being mounted on the housing, the sound emitter being turned on to emit an alert sound when the switch is actuated.

2. The audible runner traffic warning assembly according to claim 1, wherein an upper surface of the top wall and a lower surface of the bottom wall each having an area being less than 2.0 $in^2$, the housing having encompassing a total volume of less than 4.0 $in^2$.

3. The audible runner traffic warning assembly according to claim 1, wherein the wristband includes a first section attached to the housing and a second section attached to the housing opposite of the first section, a coupler releasably securing the first and second sections together.

4. The audible runner traffic warning assembly according to claim 1, wherein the wristband includes a first section attached to the housing and a second section attached to the housing opposite of the first section, a coupler releasably securing the first and second sections together, the openings being positioned between the first and second wrist sections.

5. The audible runner traffic warning assembly according to claim 1, wherein the alert sound has a frequency of between 1000 Hz and 5000 Hz.

6. The audible runner traffic warning assembly according to claim 4, wherein the switch comprises a push button being positioned on the top wall.

7. An audible runner traffic warning assembly to alert forwardly positioned persons on a path that another person is approaching from behind, the assembly comprising:

a housing having a top wall, a bottom wall, and a perimeter wall being attached to extending between the top and bottom walls, an upper surface of the top wall and a lower surface of the bottom wall each having an area being less than 2.0 $in^2$, the housing having encompassing a total volume of less than 4.0 $in^2$, the perimeter wall including a front edge, the front edge having a plurality of openings extending therethrough, the front edge being convex, the plurality of openings including a centrally positioned opening and a plurality of outer pairs being equally spaced from the central opening, each of the plurality of openings being elongated, a width of the openings of the outer pairs of openings decreasing extending away from the central opening relative to a width of the central opening, the width of each opening of each of the outer pairs of openings being equal wherein the plurality of openings are symmetrical about a central longitudinal axis of the central opening;

a wristband being attached to the housing and being configured to releasably mount the housing on a person's wrist, the wristband including a first section attached to the housing and a second section attached to the housing opposite of the first section, a coupler releasably securing the first and second sections together;

a sound emitter being mounted in the housing, the sound emitter emitting an alert sound having a volume of at least 70 decibels when turned on, the sound emitter including at least one speaker the speaker being directed toward the openings, the openings being positioned between the first and second wrist sections, the alert sound having a frequency of between 1000 Hz and 5000 Hz; and the sound emitter including a switch, the switch being mounted on the housing, the sound emitter being turned on when the switch is actuated, the switch comprising a push button being positioned on the top wall.

8. A method of warning a forward person on a path that a rearward person on the path is imminently about to pass the forward person, the method including the steps of:

placing on the wrist of the rearward person a housing having a top wall, a bottom wall, and a perimeter wall being attached to extending between the top and bottom walls, the perimeter wall including a front edge, the front edge having a plurality of openings extending therethrough, the front edge being convex, the plurality of openings including a centrally positioned opening and a plurality of outer pairs being equally spaced from the central opening, each of the plurality of openings being elongated, a width of the openings of the outer pairs of openings decreasing extending away from the central opening relative to a width of the central opening, the width of each opening of each of the outer pairs of openings being equal wherein the plurality of openings are symmetrical about a central longitudinal axis of the central opening, a wristband being attached to the housing and releasably mounting the housing on the rearward person's wrist; and actuating a sound emitter in the housing by the rearward person as the rearward person approaches the forward person to alert the forward person of a position of the rearward person and that the rearward person is about to pass the forward person, wherein the sound emitter is positioned in the housing directed to the openings; and emitting an alert sound by the sound emitter when the sound emitter is actuated.

9. The method according to claim 8, wherein the step of emitting an alert sound further includes the step of the alert sound having a volume of at least 70 decibels.

10. The method according to claim 9, wherein the step of placing the housing on the wrist further includes the step of the sound emitter including at least one speaker being directed at the openings extending through the perimeter wall of the housing.

11. The method according to claim 10, wherein the step of actuating the sound emitter further includes pressing a push button of the sound emitter, the push button being positioned on the top wall of the housing.

* * * * *